US009876292B1

(12) United States Patent
Jacques

(10) Patent No.: US 9,876,292 B1
(45) Date of Patent: Jan. 23, 2018

(54) BIDIRECTIONAL FEMALE QUICK DISCONNECT ELECTRICAL TERMINAL

(71) Applicant: ETCO Incorporated, Warwick, RI (US)

(72) Inventor: Edward H Jacques, Sarasota, FL (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 15/456,696

(22) Filed: Mar. 13, 2017

Related U.S. Application Data

(60) Provisional application No. 62/307,921, filed on Mar. 14, 2016.

(51) Int. Cl.
*H01R 11/22* (2006.01)
*H01R 4/18* (2006.01)

(52) U.S. Cl.
CPC ..... *H01R 11/22* (2013.01); *H01R 4/185* (2013.01)

(58) Field of Classification Search
CPC ..... H01R 11/22; H01R 4/185
USPC ..... 439/842, 850–852
See application file for complete search history.

(56) References Cited

U.S. PATENT DOCUMENTS 6,086,433 A * 7/2000 Hils ..... H01R 13/113 439/849
6,183,309 B1 * 2/2001 Chiang ..... H01R 4/185 439/687
6,293,831 B1 * 9/2001 Yamatani ..... H01R 13/113 439/849
6,293,832 B1 * 9/2001 Yamamoto ..... H01R 13/113 439/850
6,811,450 B1 * 11/2004 Data ..... H01R 13/114 439/181

* cited by examiner

*Primary Examiner* — Khiem Nguyen
(74) *Attorney, Agent, or Firm* — Altman & Martin; Steven K Martin

(57) ABSTRACT

A female quick disconnect electrical terminal that can be installed in either direction onto a male tab terminal. The terminal has an electrically-conductive body with a longitudinal plane with an attachment side and a contact side. An electrical attachment and a contact are on opposite ends of the body. The electrical attachment is typically a crimp attachment but any electrical attachment may be used. The contact has a floor in the plane and a spur extending away from the contact side of plane. The spur can be a dimple or bent nib. Optionally, the spur extends from a raised land. A pair of longitudinal, parallel retention rails are formed by bending wings 90° away from the contact side and curling the wings toward each other 180°. The retention rails and floor form a slot for a male tab terminal blade.

16 Claims, 12 Drawing Sheets

BIDIRECTIONAL FEMALE QUICK DISCONNECT ELECTRICAL TERMINAL

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical contacts, more particularly, to electrical quick disconnect terminals.

2. Description of the Related Art

Quick-connect terminal connectors are female terminals that mate with male tab terminals, tab adapters, and tab terminal blocks. They are used where quick attachment and removability are desired. Most existing female quick disconnect terminals are designed to be pushed onto the male terminal. When assembling white goods/appliances, one issue is that of loose and/or failed electrical connections related to the quick disconnect terminals. Those connections are on components such as heating elements and power sources, where there is a repeated burden of pushing a female terminal onto a male tab. It is also possible that, when being pushed on, the attached wire can snag on other assembly stations, possibly pulling the attachment apart.

BRIEF SUMMARY OF THE INVENTION

The present invention is a female quick disconnect electrical terminal that can be installed in either direction, by either pushing or pulling it onto the male tab terminal. The terminal has an electrically-conductive body with a longitudinal plane. The plane as two sides, an attachment side and a contact side. There is an electrical attachment at one end of the body and a contact at the other end.

The electrical attachment will typically be a crimp attachment for attaching the terminal to a wire. However, any type of electrical attachment for the particular application of the terminal may be employed.

The contact has a floor that extends in the plane. A spur extends away from the plane on the contact side of the plane. The spur can be a dimple or bent nib. Optionally, the floor has a raised land from which the spur extends.

A pair of longitudinal, parallel retention rails are attached to the contact floor on the contact side of the plane. The rails are formed by bending wings approximately 90° away from the contact side and then curling the wings toward each other approximately 180°. The retention rails are spaced from the land, forming a slot into which the blade of a male tab terminal is inserted. A combination of the spring action of the retention rails pushing the male tab terminal blade against the land and the spur fitting into a corresponding dimple or hole in the male tab terminal blade produces a secure electrical connection with the male tab terminal.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in its entirety U.S. Provisional Patent Application No. 62/307,921, on which this application is based.

Figure 1:
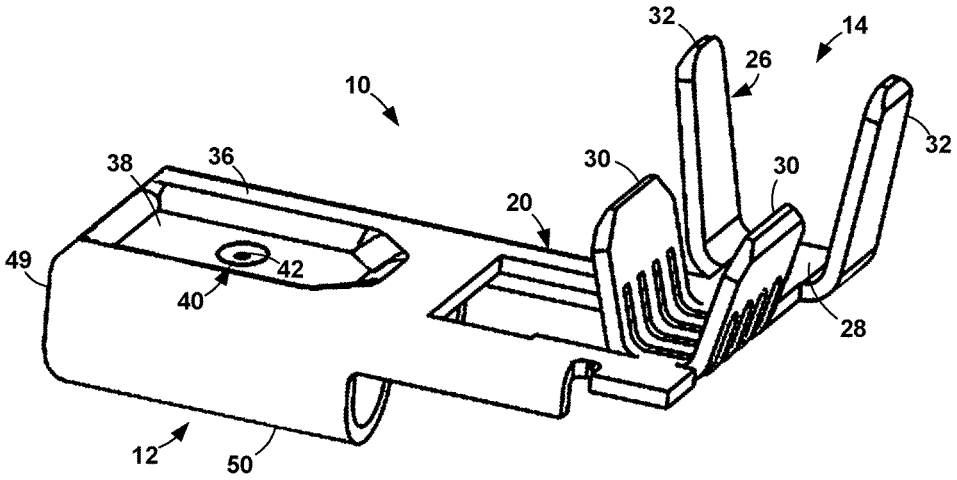
FIG. 1 shows a top, perspective view of a dimple configuration of the flag terminal of the present invention.
Figure 2:
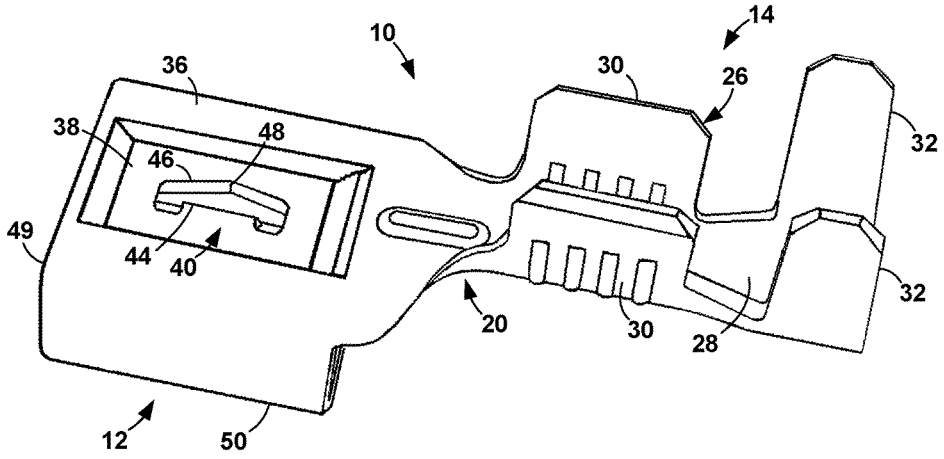
FIG. 2 shows a top, perspective view of a nib configuration of the straight terminal of the present invention.
Figure 3:
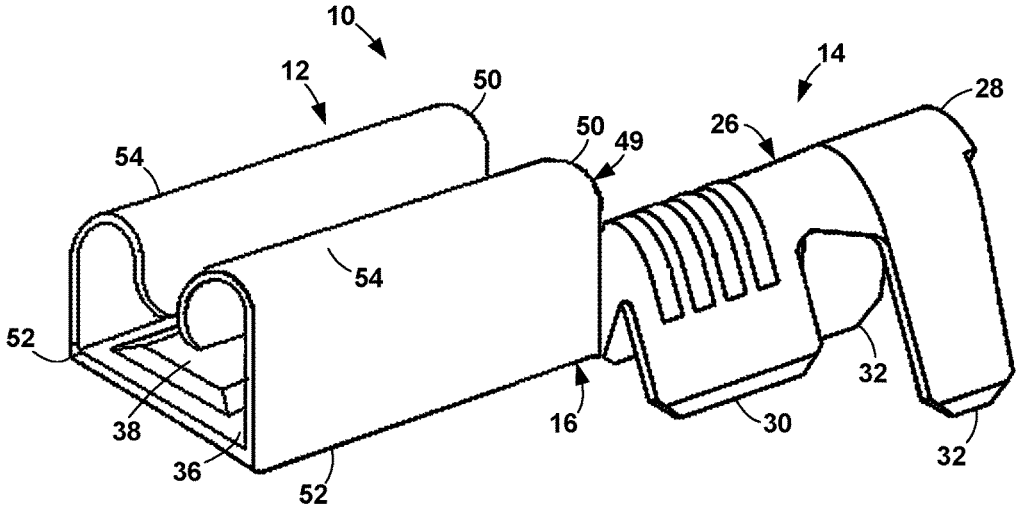
FIG. 3 shows a bottom, perspective view of a straight terminal of the present invention.
Figure 4:
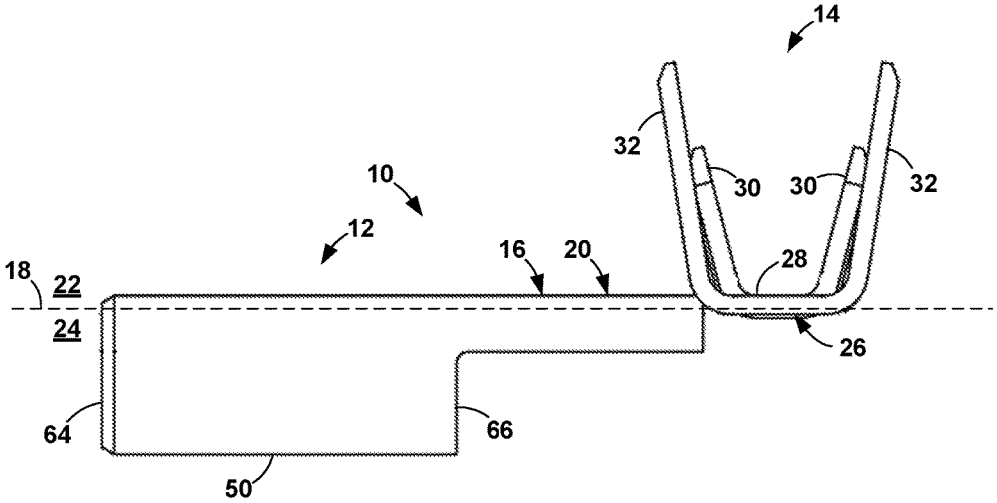
FIG. 4 shows a side view of the flag terminal.
Figure 5:
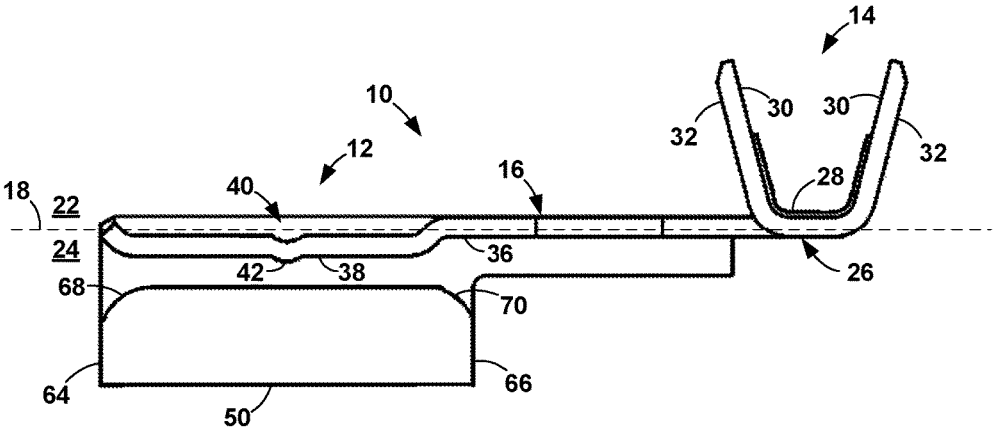
FIG. 5 shows a cross-sectional, side view of the dimple configuration of the flag terminal.
Figure 6:
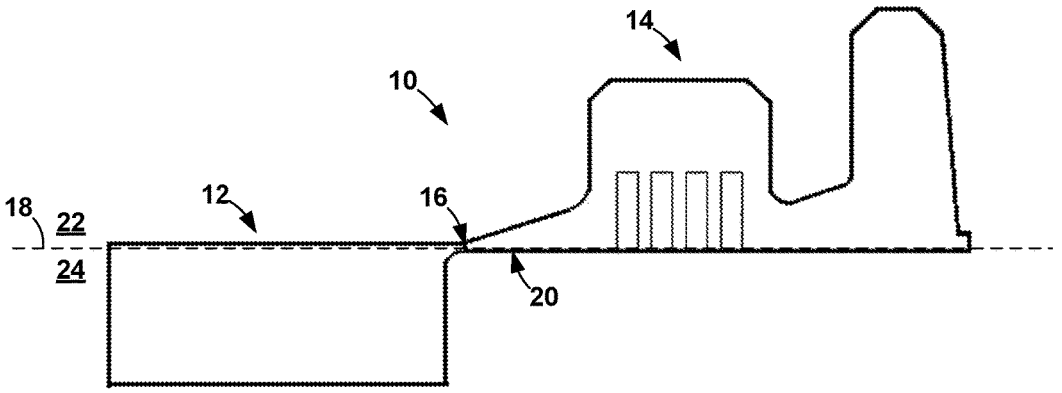
FIG. 6 shows a side view of the straight terminal.
Figure 7:
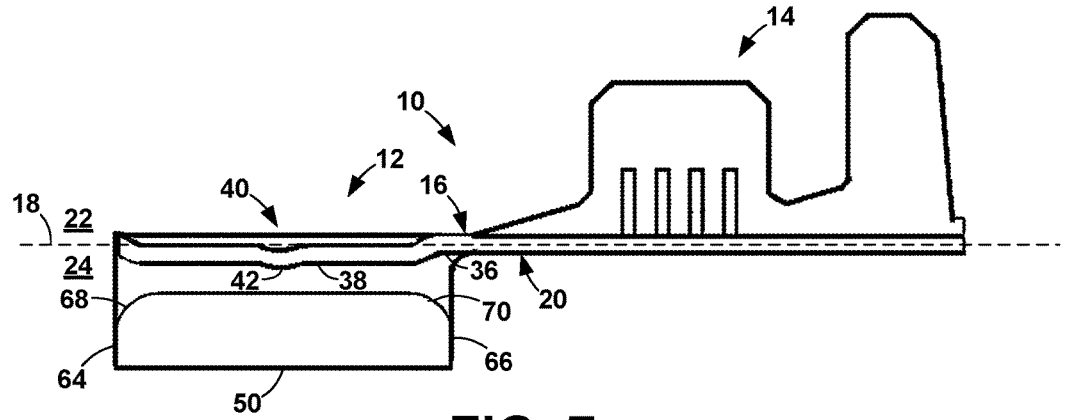
FIG. 7 shows a cross-sectional, side view of the dimple configuration of the straight terminal.

The present invention is a female quick disconnect electrical terminal that can be installed in either direction, by either pushing or pulling it onto the male tab terminal 2. The terminal 10 of the present invention can be a flag terminal, as shown in FIG. 1, or a straight terminal, as shown in FIGS. 2 and 3.

The terminal 10 has a body 16 with a longitudinal plane 18. The plane 18 as two sides, an attachment side 22 and a contact side 24, as in FIGS. 4-8. At one end of the body 16 along the plane 18 is an electrical attachment 14. At the other end of the body 16 along the plane 18 is a contact 12. An optional transition 20 bridges the electrical attachment 14 and contact 12.

The electrical attachment 14 shown in the figures is a crimp attachment 26 of a style commonly used in the industry for attaching a terminal to the end of a wire. The base 30 of the crimp attachment 26 extends along the plane 18. Two pairs of ears 30, 32 extend generally away from the crimp base 28 on the attachment side 22 of the plane 18, bending away from the base 28 toward each other to form a U. The inner pair of ears 30 crimp around the bare conductor of a wire to provide a secure electrical connection in a manner well-known in the art. The outer pair of ears 32 crimp around the insulation of the wire to provide a secure mechanical connection, a strain relief, in a manner well-known in the art.

The illustrated crimp attachment 26 is merely one form of electrical attachment 14. The present invention contemplates that any type of electrical attachment 14 that is adequate for the particular application of the terminal 10 may be employed provided that the electrical attachment 14 is substantially on the attachment side 22 of the plane 18. Small elements of the electrical attachment 14 may be on the contact side 24 as long as they do not interfere with the contact 12, as described below. For example, crimp ear ribs 34 may extend into the contact side 24 of the plane 18, as in FIG. 8.

Other examples of an electrical attachment 14 include solder attachments and detachable attachments.

The contact 12 has a floor 36 that extends in the plane 18. A spur 40 extends away from the plane 18 on the contact side 24 of the plane 18.

In the dimple configuration of FIG. 1, the spur 40 is a dimple 42 formed by any method known in the art, including embossing the floor 36.

Figure 8:
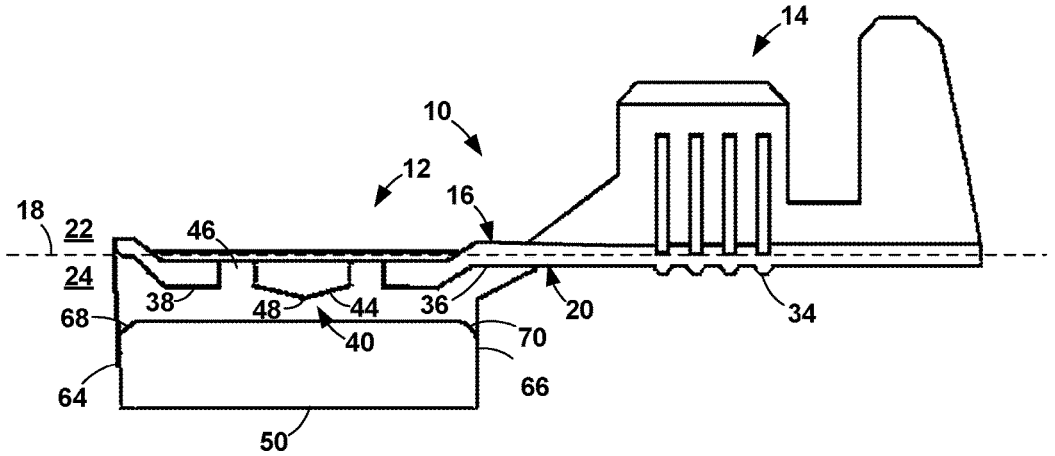
FIG. 8 shows a cross-sectional, side view of the nib configuration of the straight terminal.
Figure 9:
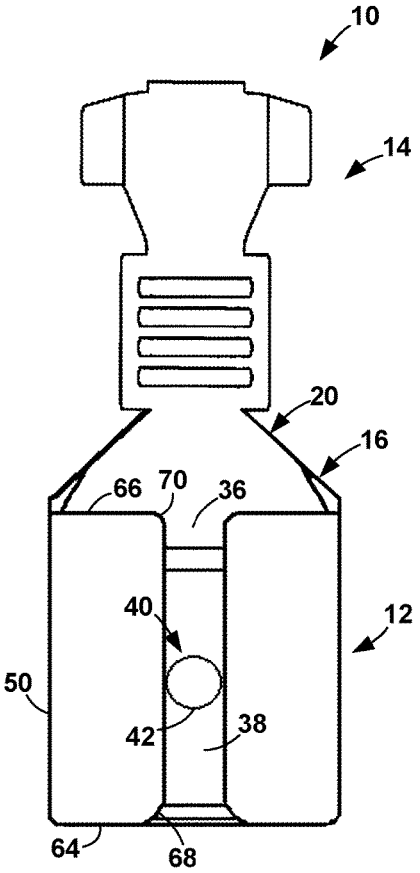
FIG. 9 shows a top view of the dimple configuration of the straight terminal.
Figure 10:
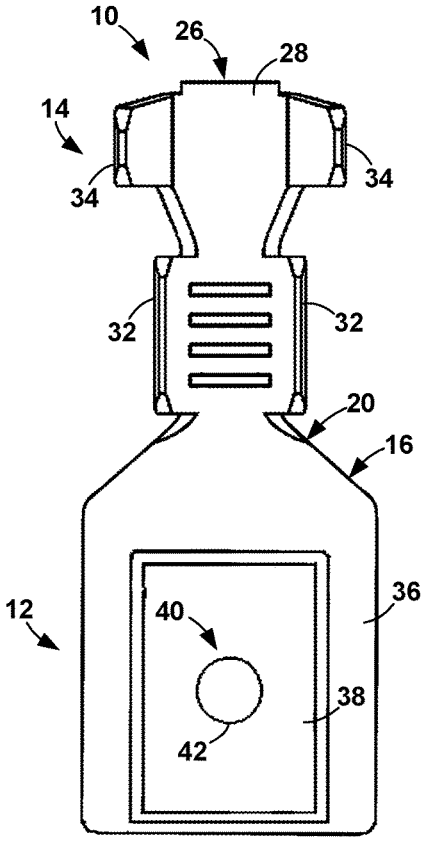
FIG. 10 shows a bottom view of the dimple configuration of the straight terminal.
Figure 11:
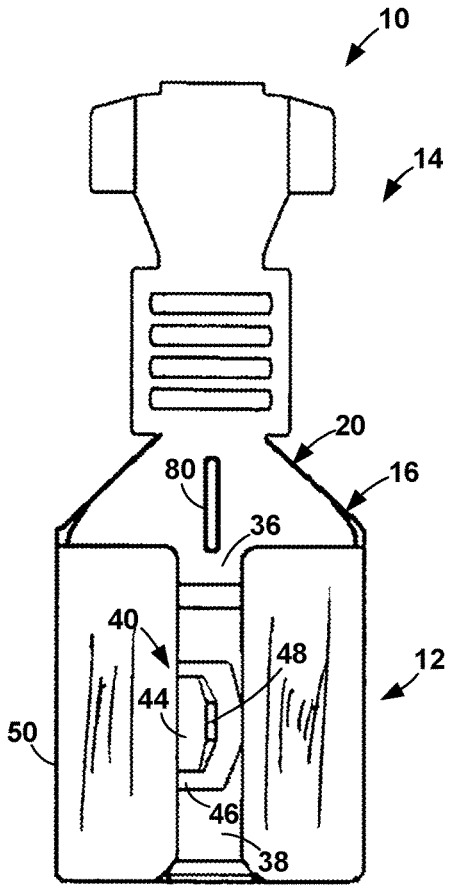
FIG. 11 shows a top view of the nib configuration of the straight terminal with a stiffening rib.
Figure 12:
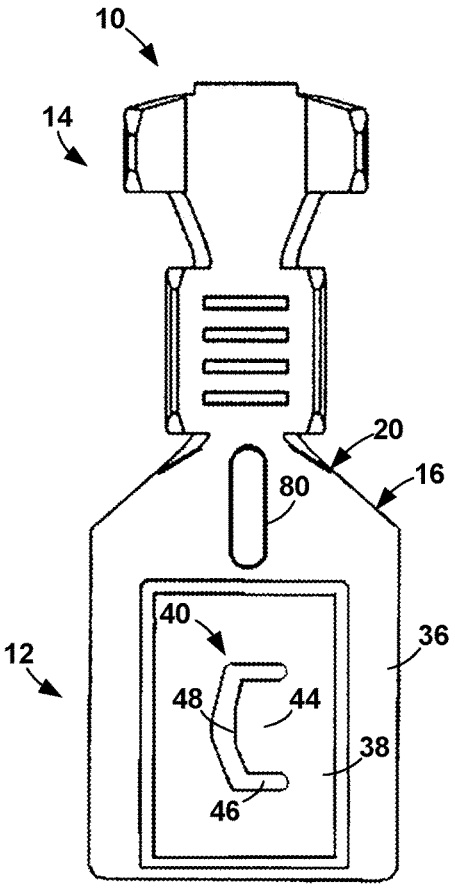
FIG. 12 shows a bottom view of the nib configuration of the straight terminal with a stiffening rib.
Figure 13:
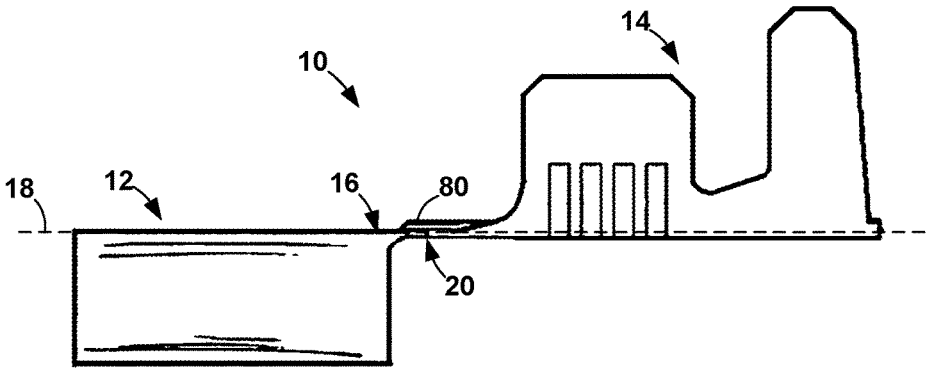
FIG. 13 shows a side view of the straight terminal with a stiffening rib.
Figure 14:
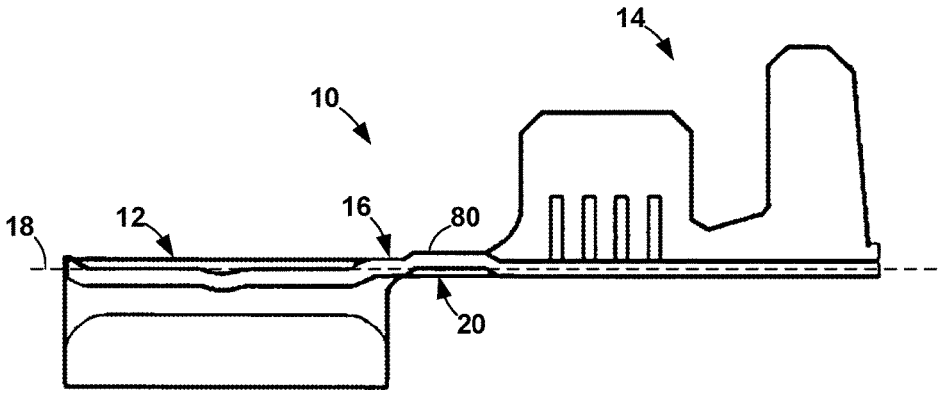
FIG. 14 shows a cross-sectional view of the dimple configuration of the straight terminal with a stiffening rib.

In the nib configuration of FIG. 2, the spur 40 is a bent nib 44 formed by punching a generally U-shaped slot 46 in the floor 36 and bending the nib 44 away from the plane 18, as seen in FIG. 8, FIG. 11 (out of the sheet), and FIG. 12 (into the sheet). Preferably, the nib 44 tapers toward the free end, as at 48.

Optionally, the floor 36 has a raised land 38 extending out of the plane 18 on the contact side 24 of the plane 18. When there is such a land 38, the spur 40 is formed in the land 38. The remainder of the present specification presumes that there is a raised land 38.

A pair of parallel retention rails 50 are attached to the contact floor 36 on the contact side 24 of the plane 18 and extend longitudinally. The rails 50 are formed by bending wings 49 approximately 90° away from the contact side 24 of the plane 18, as at 52, and then curling the wings 49 toward each other approximately 180°, as at 54. The rails 50 are separated by a gap 58.

Figure 15:
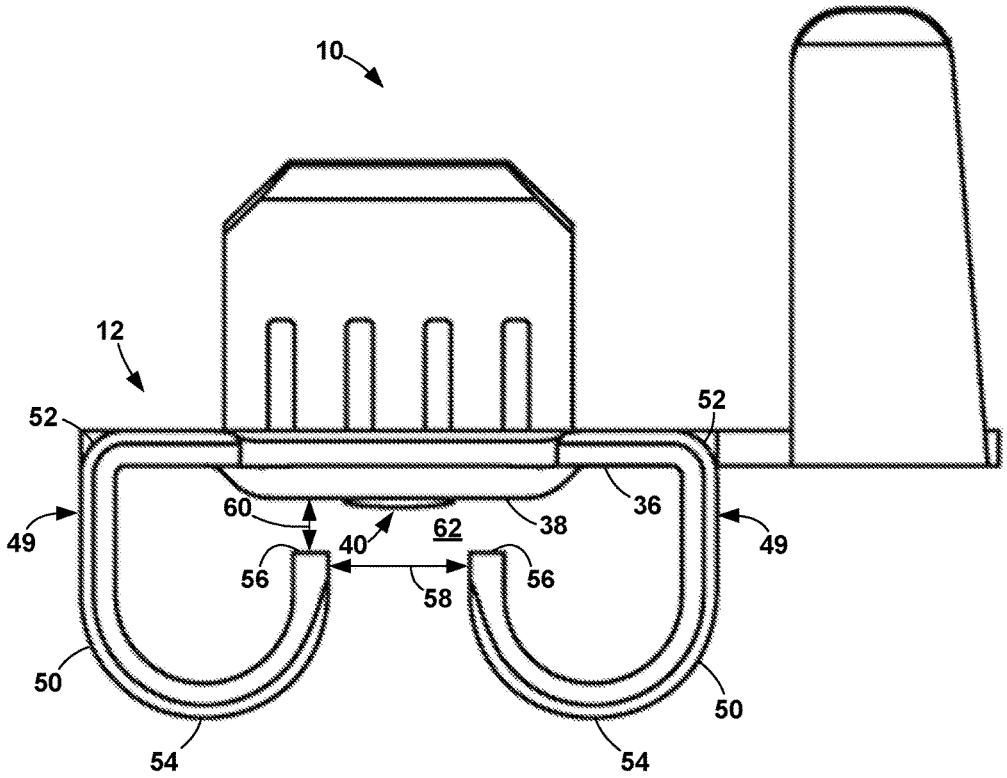
FIG. 15 shows an end view of the dimple configuration of the flag terminal.
Figure 16:
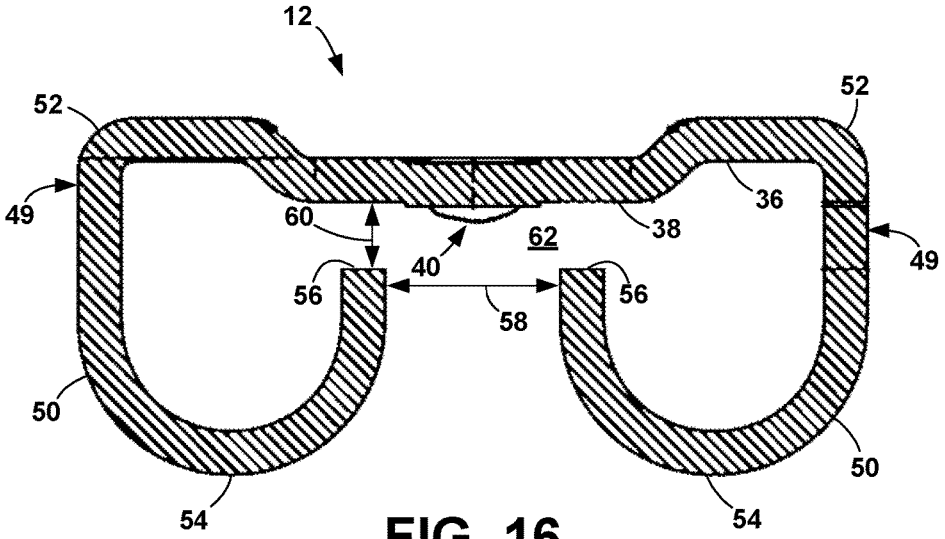
FIG. 16 shows a cross-sectional, end view of the dimple configuration of the contact portion with the rail curving 180°.
Figure 17:
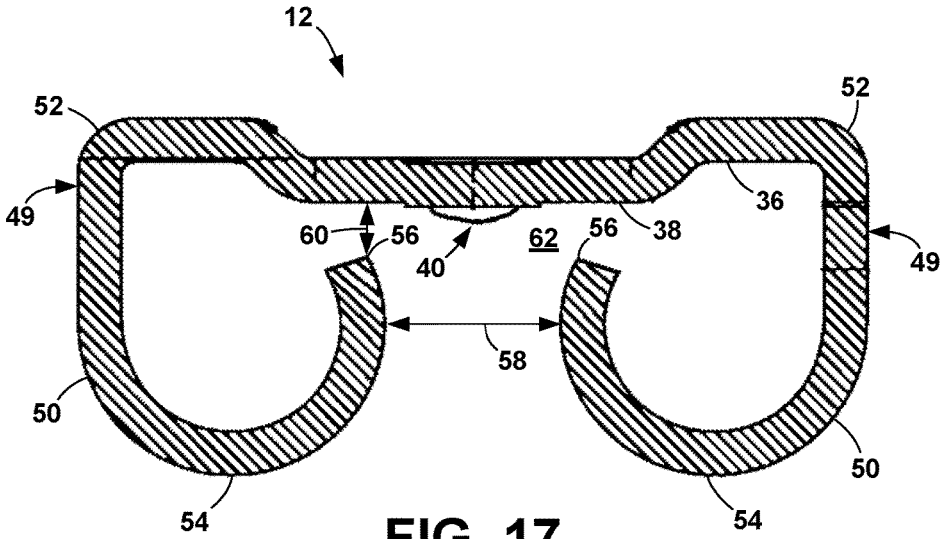
FIG. 17 shows a cross-sectional, end view of the nib configuration of the contact portion with the rail curving greater than 180°.
Figure 18:
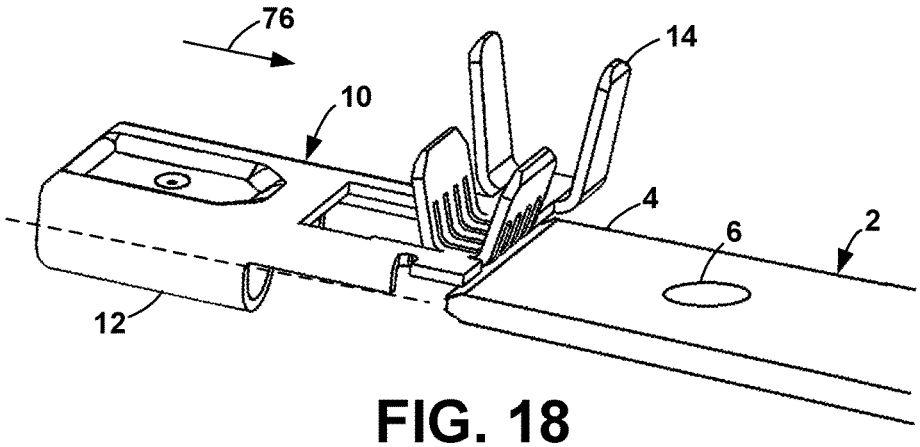
FIG. 18 shows a perspective view prior to mating with a male tab.
Figure 19:
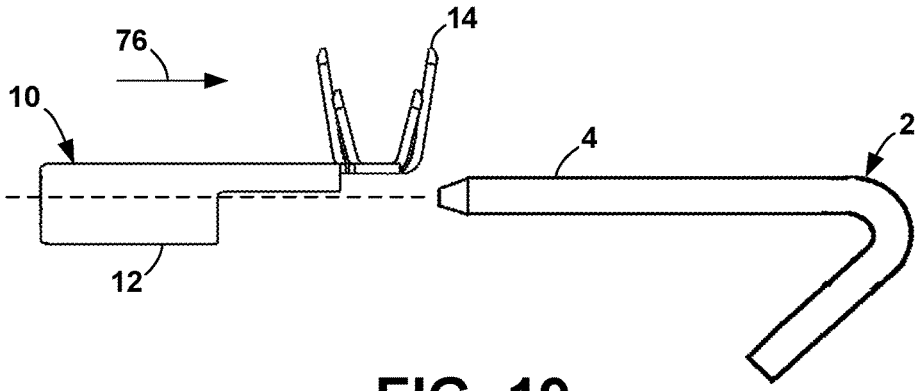
FIG. 19 shows a side view prior to mating with a male tab.
Figure 20:
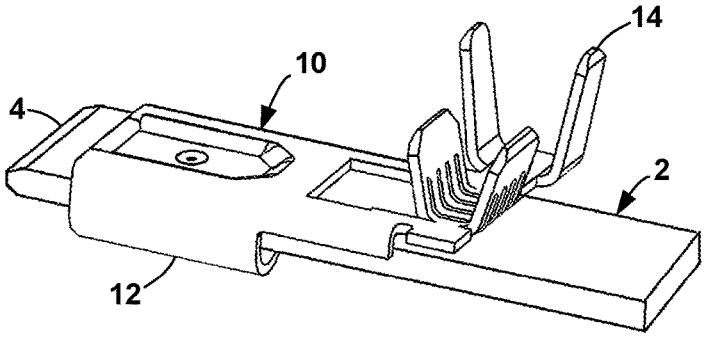
FIG. 20 shows a perspective view after mating with a male tab.
Figure 21:
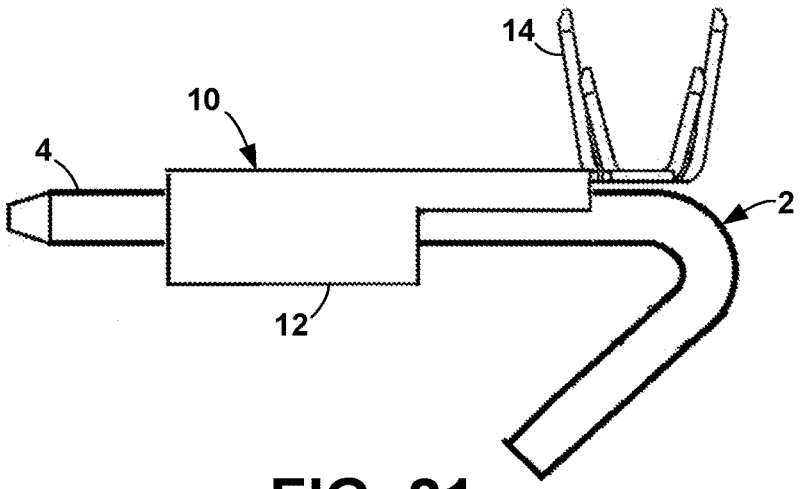
FIG. 21 shows a side view after mating with a male tab.
Figure 22:
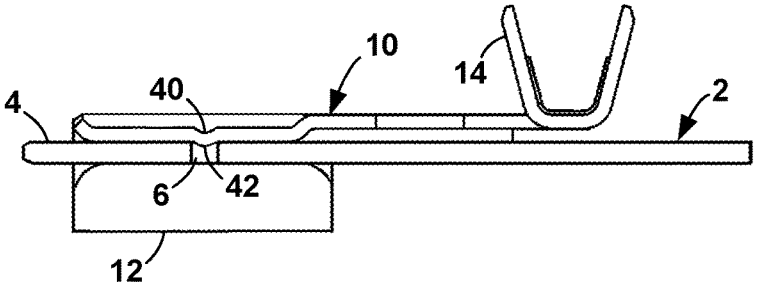
FIG. 22 shows a cross-sectional, side view of the dimple configuration after mating with a male tab.

The inner most line 56 of each retention rail 50 is spaced from the land 38, as at 60, forming a slot 62 into which the blade 4 of a male tab terminal 2 is inserted. The location of the line 56 on the rail 50 depends on the amount of curvature of the rail 50. If the rail 50 curves through 180°, the line 56 will be at the edge surface of the rail 50, as in FIGS. 15 and 16. If the rail 50 curves less than or more than 180°, the line 56 will be on a corner of the edge of the rail 50, as in FIG. 17.

The floor 36 and land 38 form one side of the slot 62 and the retention rail lines 56 form the other side of the slot 62. A combination of the spring action of the retention rails 50 pushing the male tab terminal blade 4 against the land 38 and the spur 40 fitting into a corresponding dimple or hole 6 in the male tab terminal blade 4 produces a secure electrical connection with the male tab terminal 2.

Optionally, the ends 64, 66 of the rails 50 are tapered or rounded at the corner, as at 68, 70, in order to facilitate sliding the male terminal blade 6 into the slot. The rounded corners 68, 70 guide the blade 6 into the slot 62.

Optionally, the terminal 10 has a strengthening rib 80 that strengthens the terminal 10. As shown in FIGS. 2 and 11-14, the rib 80 is a longitudinal depression that is embossed into the body 16 between the contact 12 and the electrical attachment 14. The rib 80 reduces the chances that the terminal 10 will bend during installation and use.

The terminal 10 is composed of an electrically-conductive, metallic material, such as aluminum, aluminum alloys, stainless steel, nickel-plated steel, zinc-plated steel, copper, and copper alloys, the most common being brass.

What makes the terminal 10 of the present invention unique is that the rails 50 and the electrical attachment 14 are on opposite sides 22, 24 of the plane 18. As seen in the side and cross-sectional views, FIGS. 4-8, the electrical attachment 14 is on the attachment side 22 of the plane 18 and the contact 12 is on the contact side 24 of the plane 18. In the terminal 10 of the present invention, the electrical attachment 14 does not interfere with the contact 12, thereby providing unimpeded access to the slot 62 from both directions. This design facilitates the performance of the mating process by either a pushing or a pulling action. With pulling preferred by ergonomic engineers, the terminal 10 of the present invention can be used to solve a number of assembly line issues.

Further, the side profile of the terminal 10 is relatively low, providing the ability for appliance heating elements to slide through small sheet metal openings for servicing.

In addition, the design allows multiple or stacking of female terminals on an extended male terminal blade, something not possible with most designs of the current art.

Figure 23:
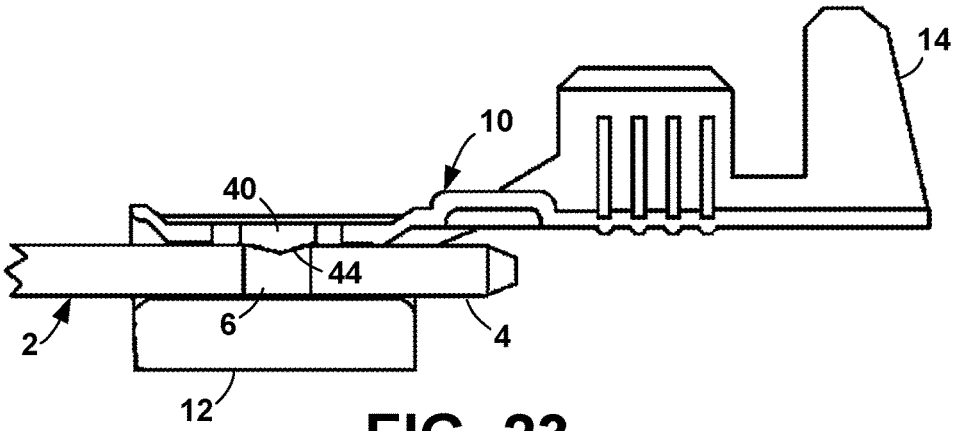
FIG. 23 shows a cross-sectional, side view of the nib configuration after mating with a male tab.
Figure 24:
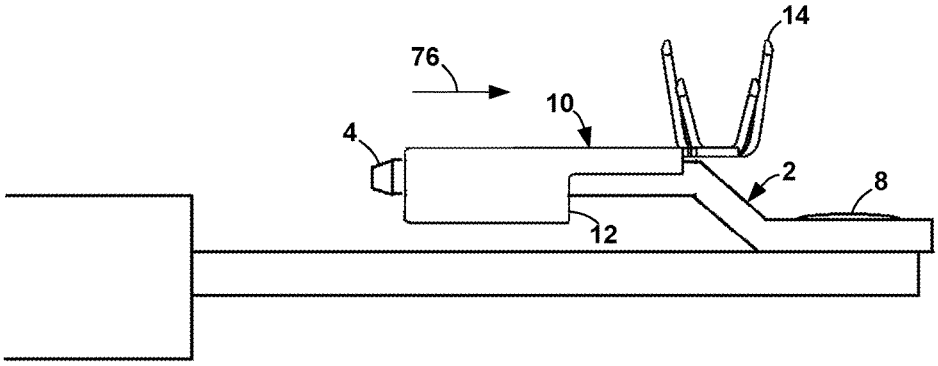
FIG. 24 shows a side view of the contact pulled onto a male weld tab.
Figure 25:
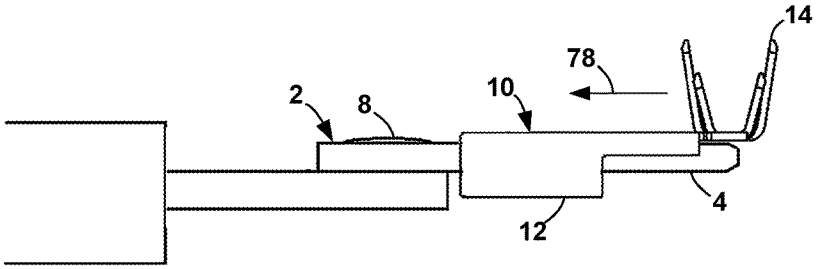
FIG. 25 shows a side view of the contact pushed onto a male weld tab.
Figure 26:
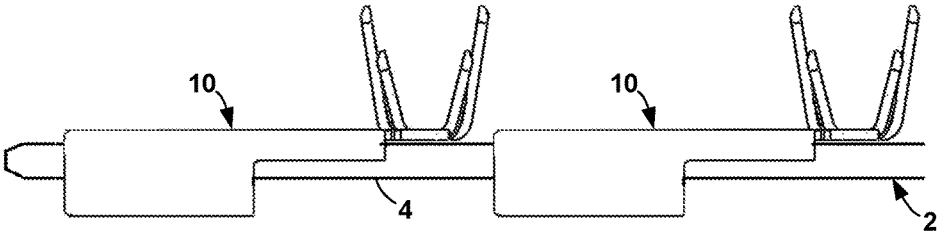
FIG. 26 shows a side view of multiple contacts mated to a single male tab.

FIGS. 18-26 show different connection methods for the terminal 10 of the present invention. FIGS. 18-22 show how the terminal 10 is pulled onto a male terminal blade 4, as at 76, for the dimple configuration. FIG. 23 shows the assembled terminal with the nib configuration. FIGS. 24 and 25 show how the terminal 10 can be either pulled 76 or pushed 78, respectively, onto a welded blade 8. FIG. 26 shows how multiple terminals 10 can be installed on a single blade 4.

Thus it has been shown and described a female quick disconnect electrical terminal with bidirectional connection. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An electrical terminal comprising:

(a) a body composed of an electrically-conductive material and extending along a longitudinal plane having an attachment side and a contact side opposite the attachment side;

(b) an electrical attachment at one end of the body and substantially on the attachment side of the plane; and (c) a contact at the other end of the body and substantially on the contact side of the plane, the contact including a floor and parallel, longitudinal retention rails attached to the floor, the floor and retention rails forming a slot adapted to accept a blade of a male electrical terminal;

(d) whereby the electrical terminal can be installed on the blade of a male electrical terminal from either end of the rails.

2. The electrical terminal of claim 1 further comprising a spur extending from the contact floor into the slot.

3. The electrical terminal of claim 2 wherein the spur extends from a raised land on the contact floor.

4. The electrical terminal of claim 2 wherein the spur is a bent nib.

5. The electrical terminal of claim 2 wherein the spur is a dimple.

6. The electrical terminal of claim 1 wherein the retention rails are formed from wings extending from the contact floor, the wings being bent away from the plane approximately 90° and then curved toward each other approximately 180°.

7. The electrical terminal of claim 1 further comprising a strengthening rib between the electrical attachment and the contact.

8. The electrical terminal of claim 1 wherein the electrical attachment is a crimp attachment.

9. An electrical terminal comprising:

(a) a body composed of an electrically-conductive material and extending along a longitudinal plane having an attachment side and a contact side opposite the attachment side;

(b) an electrical attachment at one end of the body and substantially on the attachment side of the plane; and (c) a contact at the other end of the body and substantially on the contact side of the plane, the contact including a floor and parallel, longitudinal retention rails attached to the floor, a raised land on the floor, a spur extending from the raised land away from the plane, the raised land and retention rails forming a slot adapted to accept a blade of a male electrical terminal;

(d) whereby the electrical terminal can be installed on the blade of a male electrical terminal from either end of the rails.

10. The electrical terminal of claim 9 wherein the spur is a bent nib.

11. The electrical terminal of claim 9 wherein the spur is a dimple.

12. The electrical terminal of claim 9 wherein the retention rails are formed from wings extending from the contact floor, the wings being bent away from the plane approximately 90° and then curved toward each other approximately 180°.

13. The electrical terminal of claim 9 further comprising a strengthening rib between the electrical attachment and the contact.

14. An electrical terminal comprising:

(a) a body composed of an electrically-conductive material and extending along a longitudinal plane having an attachment side and a contact side opposite the attachment side;

(b) an electrical attachment at one end of the body and substantially on the attachment side of the plane;

(c) a contact at the other end of the body and substantially on the contact side of the plane, the contact including a floor and parallel, longitudinal retention rails attached to the floor, a raised land on the floor, a spur extending from the raised land away from the plane, the retention rails being formed from wings extending from the contact floor, the wings being bent away from the plane approximately 90° and then curved toward each other approximately 180°, the raised land and retention rails forming a slot adapted to accept a blade of a male electrical terminal; and (d) a strengthening rib between the electrical attachment and the contact;

(e) whereby the electrical terminal can be installed on the blade of a male electrical terminal from either end of the rails.

15. The electrical terminal of claim 14 wherein the spur is a bent nib.

16. The electrical terminal of claim 14 wherein the spur is a dimple.

* * * * *